United States Patent [19]

Abendroth

[11] Patent Number: 4,589,243

[45] Date of Patent: May 20, 1986

[54] FLOORING SYSTEM WITH STRIP OF RESILIENT MATERIAL IN COMPRESSION

[76] Inventor: Carl W. Abendroth, 210 Crystal Ave., Crystal Falls, Wis. 49920

[21] Appl. No.: 608,389

[22] Filed: May 9, 1984

Related U.S. Application Data

[63] Continuation-in-part of Ser. No. 387,184, Jun. 10, 1982, Pat. No. 4,449,342.

[51] Int. Cl.[4] ..... E04B 1/62

[52] U.S. Cl. ..... 52/403; 52/480

[58] Field of Search ..... 52/480, 393, 403

[56] References Cited

U.S. PATENT DOCUMENTS

| | | | |
|---|---|---|---|
| Re. 18,573 | 8/1932 | Kocher . | |
| Re. 26,239 | 4/1958 | Rockabrand et al. | 52/403 |
| 2,554,657 | 5/1951 | Betterton et al. | 105/375 |
| 2,862,255 | 12/1958 | Nelson | 20/6 |
| 3,045,294 | 7/1962 | Livezey, Jr. | 20/8 |
| 3,270,475 | 9/1966 | Kodaras | 52/480 |
| 3,271,916 | 9/1966 | Omholt | 52/480 X |
| 3,473,281 | 9/1966 | Omholt | 52/480 |
| 3,518,800 | 7/1970 | Tank | 52/480 |
| 3,596,422 | 8/1971 | Boettcher | 52/480 X |
| 3,604,173 | 9/1971 | Dahlborg | 52/508 |

OTHER PUBLICATIONS

AGA, Hard Maple Flooring Systems brochure, published in Oct. of 1980.

*Primary Examiner*—Carl D. Friedman

*Attorney, Agent, or Firm*—Michael, Best & Friedrich

[57] ABSTRACT

A flooring system comprising a foundation and underlayment on the foundation. The underlayment includes a plurality of parallel grooves. The flooring system also includes support members in the grooves, floorboards superposed on the support members and the underlayment, strips of rubber between the floorboards and the underlayment and between the grooves and fasteners for fastening the floorboards to the support members so that the rubber strips are in compression between the floorboards and the underlayment. The floorboards are superposed at right angles on the support members and the combined height of an uncompressed rubber strip and the underlayment between the grooves is greater than the combined height of one of the support members and the underlayment below one of the grooves.

21 Claims, 7 Drawing Figures

FLOORING SYSTEM WITH STRIP OF RESILIENT MATERIAL IN COMPRESSION

RELATED APPLICATION

This application is a continuation-in-part of U.S. Abendroth patent application designated as Ser. No. 387,184 and filed June 10, 1982, now U.S. Pat. No. 4,449,342.

BACKGROUND OF THE INVENTION

This invention relates to flooring systems and, more particularly, to flooring systems including means for improving the shock absorbing action of the flooring system.

Various systems for applying, mounting and securing floorboards to support members have been proposed to provide a resilient sports floor surface. Examples of such flooring systems can be found in U.S. Pat. No. 3,604,173, Dahlborg; U.S. Pat. No. 2,862,255 Nelson; U.S. Pat. No. 3,473,281 Omholt, U.S. Pat. No. Re. 26,239 Rockabrand et al and U.S. Pat. No. 3,045,294 Livezey.

U.S. Pat. No. Re. 18,573, Kocher discloses a sound deadening device for use particularly in flooring construction. The sound deadening device includes a felt strip both above and below a wooden sleeper uksed for supporting floorboards. U.S. Pat. No. 3,270,475, Kodaras discloses wooden support members with a bottom base layer of soft, low density cushioning material and a top layer of soft compressible material. Attention is also directed to U.S. Pat. No. 2,554,657 Belterton et al cited during the prosecution of the parent application.

SUMMARY OF THE INVENTION

This invention provides a flooring system comprising a foundation and an underlayment on the foundation. The underlayment includes a plurality of spaced-apart parallel grooves. The flooring system also includes a plurality of support members in the grooves, a plurality of floorboards superposed on the support members and the underlayment, a plurality of strips of resilient material between the floorboards and the underlayment and between the grooves, and means for fastening the floorboards to the support members so that the strips of resilient material are in compression between the floorboards and the underlayment.

In one embodiment, the support members comprise steel channels and the means for fastening the floorboards to the steel channels comprises clips.

In another embodiment, the support members comprise laminated strips and the means for fastening the floorboards to the laminated strips comprises anchors. The laminated strips each comprise a first metal strip, a second metal strip and a wood strip connected between the first and second metal strips.

In one embodiment, the floorboards are superposed at right angles on the support members and the combined height of an uncompressed strip of the resilient material and the underlayment between the grooves is greater than the combined height of one of the support members and the underlayment below one of the grooves. The strip of resilient material is made of rubber.

One of the principal features of the invention is the provision of a relatively inexpensive flooring system which is under uniform tension and which deflects as well as more costly flooring systems. In this regard, a flooring system under uniform tension provides full cushioning of impact for shock absorbing action with a uniform response, thereby making the floor ideal as a high performance sports surface.

Other features and advantages of the invention will become apparent upon review of the detailed description, the drawings, and the appended claims.

Figure 1:
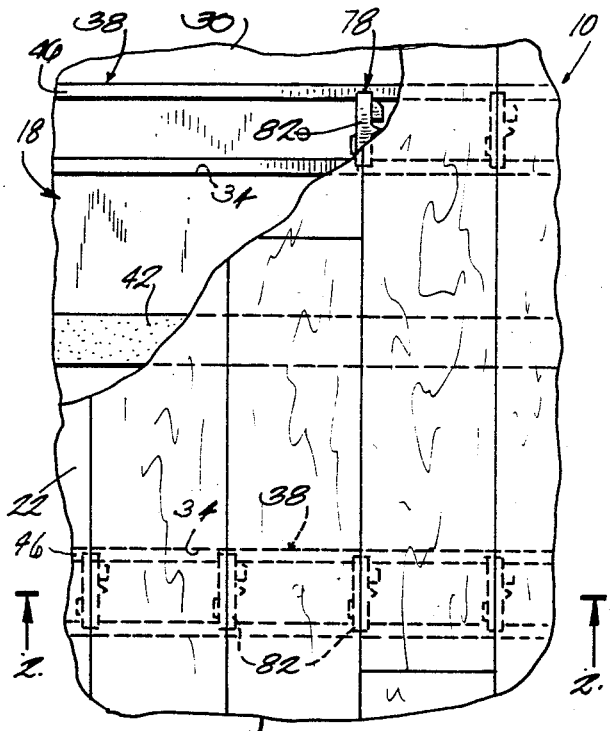
FIG. 1 is a top view, partially broken away, of a portion of a flooring system which embodies various of the features of the invention.

Before explaining at least one embodiment of the invention in detail, it is to be understood that the invention is not limited in its application to the details of construction and the arrangements of components set forth in the following description or illustrated in the drawings. The invention is capable of other embodiments, and of being practiced or carried out in various ways. Also, it is to be understood that the phraseology and terminology employed herein is for the purposes of description and should not be regarded as limiting.

DESCRIPTION OF PREFERRED EMBODIMENTS

Figure 2:
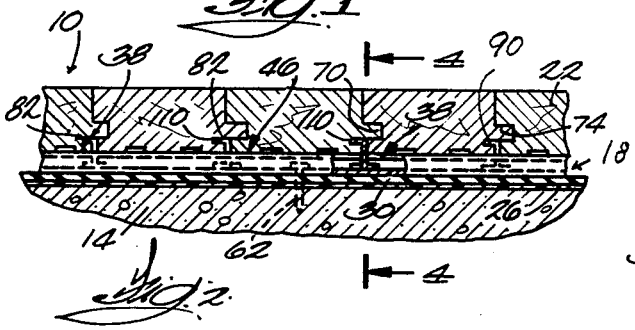
FIG. 2 is a cross-sectional view of the flooring system taken along the line 2—2 in FIG. 1.
Figure 4:
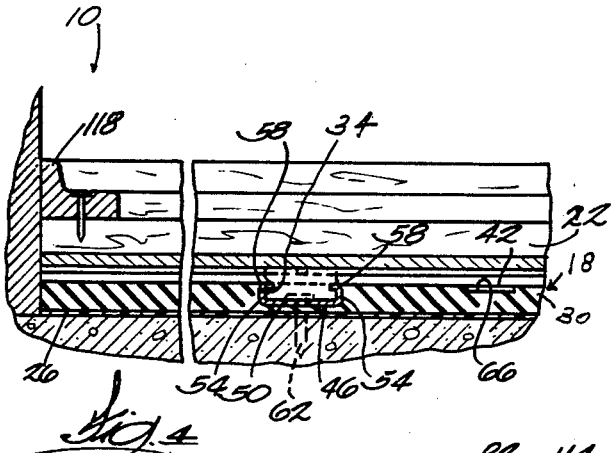
FIG. 4 is a cross-sectional view of the flooring system taken along the line 4—4 in FIG. 2.

With particular reference to the drawings and particularly FIGS. 1, 2 and 4, a flooring system 10 is illustrated including a foundation 14, a subfloor assembly 18 and floorboards 22 superposed on the subfloor assembly 18.

The foundation or slab 14 is a concrete subfloor which has been finished and leveled. Placed on top of the leveled slab 14 is a vapor barrier 26 preferrably made of 6 mil polyethelene with four inch lap joints cemented with cold asphalt.

The subfloor assembly 18 comprises an underlayment 30 laid on the vapor barrier 26 and including a plurality of spaced-apart parallel grooves 34 (see FIG. 4) which extend across the shorter dimension of the flooring system 10, a plurality of support members 38 (see FIGS. 1 and 4) which have uniform dimensions and which are received in the grooves 34, and a plurality of strips of resilient material 42 which are on the underlayment 30 and between the support members 38 in the grooves 34.

Although various materials can be used, in the preferred embodiment, the underlayment 30 is a resilient insulation board made of asphalt impregnated fiber board. In other embodiments, other materials, such as rigid foam or flexible closed cell expanded polyethelene foam, can be used.

In the preferred embodiment, the underlayment 30 is at least one-half inch thick and the grooves extend approximately ¾ths of the way through the resilient underlayment 30.

Although various types of support members 38 made of different materials can be used, in the embodiment illustrated in FIGS. 1 through 4, each of the support members 38 comprises a channel 46 made of sixteen gauge zinc plated steel. As illustrated in FIG. 4, the steel channel 46 has a flattened C-type configuration comprising a horizontal base portion 50, two spaced apart vertical side portions 54 extending from the base portion 50, and two upper horizontal flange portions 58 which extend from the vertical side portions 54 toward each other. The horizontal flanges 58 do not reach each other and therefore leave an opening into the interior of the channel 46. The dimension between the upper outer surface and the lower outer surface of each channel 46 is approximately the same as each groove 34. As a result, the upper surface of each channel 46 is flush with the upper surface of the underlayment 30 between the grooves 34.

As illustrated in FIGS. 2 and 4, the underlayment 30 and steel channels 46 are secured to the foundation 14 by means of anchors 62 driven through the channels 46 at approximately fourteen inch intervals.

The strips 42 of resilient material are preferrably made of rubber and are placed on the underlayment 30 between the parallel grooves 34 which receive the support members 38. In the preferred embodiment, each of the rubber strips 42 extends nearly the full width of the flooring system 10. Other types of resilient materials such as polyurethane and PVC may be used. In other embodiments, the strips 42 can be spaced at intervals across the flooring system 10.

As illustrated in FIG. 4, in the preferred embodiment, the rubber strips 42 are held in grooves 66 in the underlayment 30, and the depth of each rubber strip groove 66 is less than the uncompressed thickness of each rubber strip 42. In other embodiments (not shown), the rubber strips 42 can lay on and deflect the upper surface of resilient underlayment 30 or can be held in grooves in the floorboards 22 superposed on the support members 38 and the rubber strips 42. The depth of each such rubber strip groove in the floorboards 22 would be less than the uncompressed thickness of each rubber strip 42.

As illustrated in FIG. 1, superposed at right angles on the support members 38 and the rubber strips 42 are adjacent rows of the floorboards 22 with tongues 70 and grooves 74. The floorboards 22 cover the subfloor assembly 18 and the ends of the floorboards 22 are staggered from row to row.

As illustrated in FIG. 1, the floorboards 22 are secured in place by means 78 for fastening the floorboards 22 to the support members 38 so that the rubber strips 42 are in compression between the floorboards 22 and the underlayment 30. In the embodiment illustrated in FIGS. 2, 3 and 4, the means 78 for fastening the floorboards to the steel channels comprises a plurality of clips 82.

Figure 3:
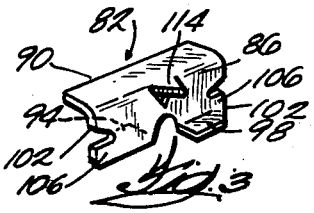
FIG. 3 is a perspective view of a clip used in the flooring system shown in FIG. 1.

As illustrated in FIG. 3, each clip 82 comprises a central vertical portion 86, an upper horizontal portion 90 which extends from the top of the vertical portion 86, and two lower opposed horizontal base or leg portions 94 and 98, respectively, which extend from the base of the vertical portion 86 in opposite directions. One leg portion 94 extends in one direction from near the midpoint of the vertical portion 86 to the outer edge of the vertical portion 86, and the other leg portion 98 extends in the other direction from near the midpoint of the vertical portion 86 to the other edge of the vertical portion 86.

The edges 102 of the central vertical portion 86 are recessed to receive the horizontal flanges 58 of the flattened C-shaped channel 46. As a result, portions 106 of the vertical portion 86 are held below the horizontal flanges 58, thus securing the clip 82 in the steel channel 46. To position the clip 82 in the channel 46, the clip 82 is inserted into the channel 46 and then rotated so the lower portions 106 of the vertical portion 86 are below the channel flanges 58.

As illustrated in FIG. 2, the upper horizontal portion 90 of each clip 82 is received in a groove 110 which is in the side of each floorboard 22 and which extends into the floorboard 22 beneath the tongue 70. In other embodiments, (not shown) the horizontal portion 90 can be received below the tongue 70 in an enlarged version of the groove 74 provided for the tongue 70.

The clip 82 further includes a triangular shaped prong 114 which extends from the top of the vertical central portion 86 in a direction opposite the horizontal portion 90. The triangular prong 114 helps hold the floorboards 22 and assists in the assembly of the flooring system 10 in the following manner. After a floorboard 22 is superposed at a right angle over the steel channel 46, the clip 82 is secured to the floorboard 22 by inserting the horizontal portion 86 of the clip 82 into the groove 110 of the floorboard 22. Another floorboard 22 is laid adjacent the prior floorboard and the prong 114 is forced into the floorboard to hold it in place. As illustrated in FIG. 1, the clips 82 are used to secure the floorboards 22 in each area of a side of a floorboard 22 above a steel channel 46.

As illustrated in FIG. 4, to finish the flooring system, molding 118 is nailed to the floorboards 22 around the perimeter of the floorboards 22 to cover any perimeter voids.

Figure 5:
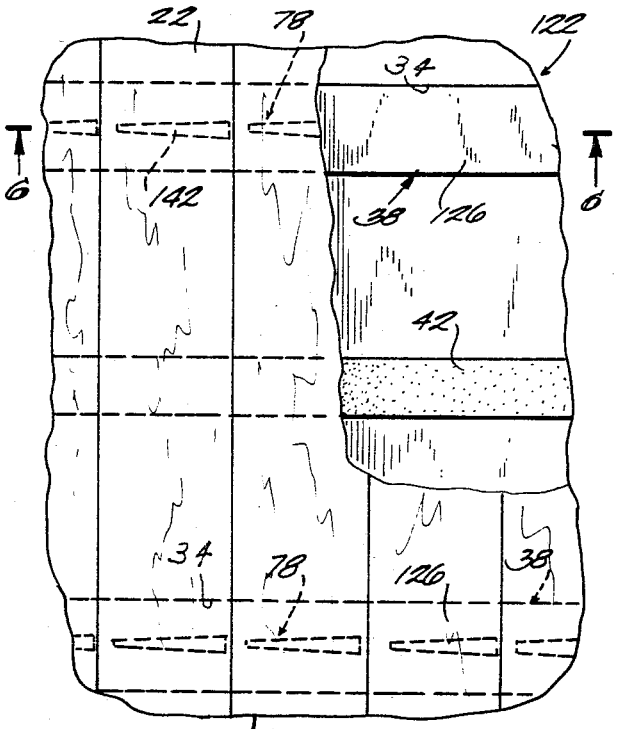
FIG. 5 is a top view, partially broken away, of another flooring system which embodies various features of the invention.
Figure 6:
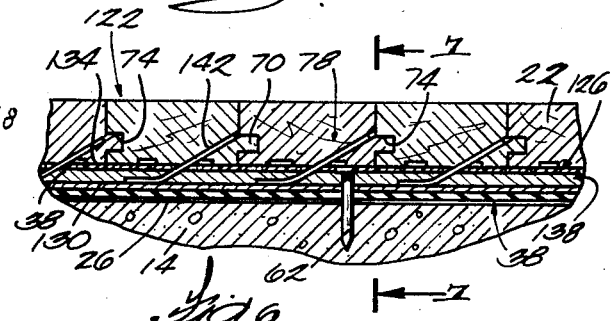
FIG. 6 is a cross-sectional view of the flooring system taken along the line 6—6 in FIG. 5.
Figure 7:
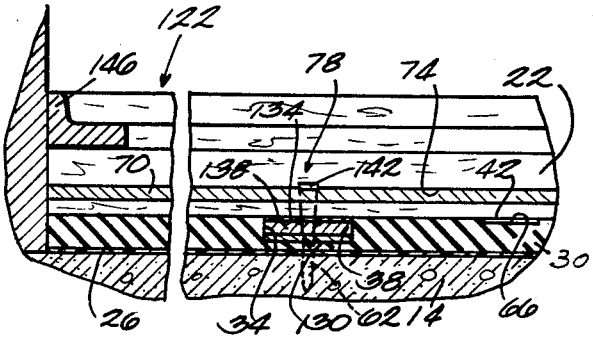
FIG. 7 is a cross-sectional view of the flooring system taken along the line 7—7 in FIG. 6.

An alternate embodiment 122 of the flooring system 10 is shown in FIGS. 5 through 7. Various components of the flooring system 122 are the same as the flooring system 10 shown in FIGS. 1, 2 and 4, and like numerals are used to designate similar elements.

In embodiment 122, the support members 38 comprise laminated strips 126. The depth of each laminated strip 126 is approximately the same as each groove 34. Each laminated strip 126 comprises a first lower metal strip 130, a second upper metal strip 134, and a wood strip 138 connected between the first metal strip 130 and the second metal strip 134. In the preferred embodiment, the lower metal strip 130 is made of sixteen guage steel, the upper metal strip 134 is made of thirty guage steel, and the wood strip 138 is made of hard maple. The laminated strips 126 are laid end to end in the parallel grooves 34 in the underlayment 30 and secured to the foundation 14 by anchors 62 spaced at fourteen inch intervals, and the ends of the laminated strips 126 are staggered from row to row.

In the embodiment 122, the means 78 for fastening the floorboards 22 to the laminated strips 126 comprises anchors 142 which are driven at an angle into the floorboards 22 above the tongue 70 in the area of the floorboards 22 above the laminated strips 126. The anchors 142 are driven through the floorboard 22 and through the upper strip 134, and then through the wood strip 138, where the anchors 142 are then deflected off the lower strip 130 back into the wood strip 138.

In the embodiment 122, the perimeter of the flooring system is finished with a ventilating rubber base 146 which is secured to the floorboards 22 by an appropriate adhesive.

Various of the features of the invention are set forth in the following claims.

I claim:

1. A flooring system comprising a foundation, an underlayment on said foundation, said underlayment being fabricated of a first material and including a plurality of spaced-apart parallel grooves, a plurality of support members in said grooves, a plurality of floorboards superposed on said support members and said underlayment, a plurality of strips of resilient material fabricated of a second material different from said first material and located between said floorboards and said underlayment and between said grooves, and means for fastening said floorboards to said support members so that said strips of resilient material are in compression between said floorboards and said underlayment.

2. A flooring system in accordance with claim 1 wherein said support members comprise steel channels and wherein said means for fastening said floorboards to said steel channels comprises clips.

3. A flooring system in accordance with claim 1 wherein said support members comprise laminated strips and wherein said means for fastening said floorboards to said laminated strips comprises anchors.

4. A flooring system in accordance with claim 3 wherein said laminated strips each comprise a first metal strip, a second metal strip, and a wood strip connected between said first metal strip and said second metal strip.

5. A flooring system in accordance with claim 1 wherein said floorboards are superposed at right angles on said support members.

6. A flooring system in accordance with claim 1 wherein the combined height of one of said uncompressed strips of said resilient material and said underlayment between said grooves is greater than the combined height of one of said support members and the underlayment below one of said grooves.

7. A flooring system in accordance with claim 1 wherein said strips of resilient material are received in grooves in said underlayment.

8. A flooring system comprising a foundation, an underlayment on said foundation, said underlayment including a plurality of spaced-apart parallel grooves, a plurality of support members in said grooves, a plurality of floorboards superposed on said support members and said underlayment, a plurality of rubber strips between said floorboards and said underlayment and between said grooves, and means for fastening said floorboards to said support members so that said strips of resilient material are in compression between said floorboards and said underlayment.

9. A flooring system in accordance with claim 8 wherein the combined height of one of said rubber strips in uncompressed condition and said underlayment between said grooves is greater than the combined height of one of said support members and the underlayment below one of said grooves.

10. A flooring system in accordance with claim 8 wherein said rubber strips are received in additional grooves in said underlayment.

11. A flooring system comprising a foundation, an underlayment on said foundation, said underlayment including a plurality of spaced-apart parallel grooves, a plurality of support members in said grooves, a plurality of floorboards superposed on said support members and said underlayment, a plurality of rubber strips between said floorboards and said underlayment and between said grooves, the combined height of an uncompressed rubber strip and said underlayment between said grooves being greater than the combined height of one of said support members and the underlayment below one of said grooves, and means for fastening said floorboards to said support members so that said rubber strips are in compression between said floorboards and said underlayment.

12. A flooring system in accordance with claim 11 wherein said support members comprise steel channels and wherein said means for fastening said floorboards to said steel channels comprises clips.

13. A flooring system in accordance with claim 11 wherein said support members comprise laminated strips and wherein said means for fastening said floorboards to said laminated strips comprises anchors.

14. A flooring system in accordance with claim 13 wherein said laminated strips each comprise a first metal strip, a second metal strip, and a wood strip connected between said first metal strip and said second metal strip.

15. A flooring system in accordance with claim 11 wherein said rubber strips are received in grooves in said underlayment.

16. A flooring system comprising a foundation, an underlayment on said foundation, said underlayment including a plurality of spaced-apart parallel grooves, a plurality of support members in said grooves, a plurality of floorboards superposed on said support members and said underlayment, a plurality of strips of resilient material located vertically between said floorboards and said underlayment and located horizontally between and in horizontally spaced relation to said grooves, and means for fastening said floorboards to said support members so that said strips of resilient material are in compression between said floorboards and said underlayment.

17. A flooring system in accordance with claim 16 wherein the combined height of one of said uncompressed strips of said resilient material and said underlayment between said grooves is greater than the combined height of one of said support members and the underlayment below one of said grooves.

18. A flooring system in accordance with claim 16 wherein said strips of resilient material are received in additional grooves in said underlayment.

19. A flooring system comprising a foundation, an underlayment on said foundation, said underlayment being fabricated of a first material and having first portions of a given height and a plurality of spaced apart parallel second portions of a second height less than said given height, whereby to define in said underlayment a plurality of spaced-apart parallel grooves having a depth less than said given height, a plurality of support members respectively located on said plurality of said second underlayment portions and in said grooves, a plurality of floorboards superposed on said support members and said underlayment, a plurality of strips of resilient material fabricated of a second material different from said first material and located between said floorboards and said underlayment and between said grooves, and means for fastening said floorboards to said support members so that said strips of resilient material are in compression between said floorboards and said underlayment.

20. A flooring system in accordance with claim 19 wherein the combined height of one of said uncompressed strips of said resilient material and said underlayment between said grooves is greater than the combined height of one of said support members and the underlayment below one of said grooves.

21. A flooring system in accordance with claim 19 wherein said strips of resilient material are received in additional grooves in said underlayment.

* * * * *